US007618286B2

(12) United States Patent
Aoki et al.

(10) Patent No.: US 7,618,286 B2
(45) Date of Patent: Nov. 17, 2009

(54) SHIELD CONNECTOR

(75) Inventors: Eiji Aoki, Makinohara (JP); Tomokazu Yamane, Makinohara (JP); Takeaki Kaneko, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/272,285

(22) Filed: Nov. 17, 2008

(65) Prior Publication Data

US 2009/0130901 A1 May 21, 2009

(30) Foreign Application Priority Data

Nov. 16, 2007 (JP) ..... 2007-297725

(51) Int. Cl.
*H01R 13/40* (2006.01)

(52) U.S. Cl. ..... 439/587

(58) Field of Classification Search ..... 439/587, 439/584, 274, 275; 174/376, 377, 359
See application file for complete search history.

(56) References Cited

U.S. PATENT DOCUMENTS 6,190,212 B1 * 2/2001 Brown et al. ..... 439/736
6,787,701 B2 * 9/2004 Yasuda et al. ..... 174/664
7,264,506 B2 * 9/2007 Mori et al. ..... 439/606

* cited by examiner

*Primary Examiner*—Phuong K Dinh
(74) *Attorney, Agent, or Firm*—Sughrue Mion, PLLC

(57) ABSTRACT

A shield connector 40 includes terminal-equipped wires 13 each having a terminal 31 connected to an end portion of its wire 30, a housing 11 receiving the terminals 31 of the terminal-equipped wires 13, a shielding shell 12 mounted on the housing 11, and waterproof plugs 41 each mounted at least on the terminal 31 of the corresponding terminal-equipped wire 13 and the end portion of the wire 30 at a region between the housing 11 and the shielding shell 12. The shielding shell 12 has wire passage holes 26 and 27 formed in a rear face thereof, and the wires 30 led out from the housing 11 disposed on a front face of the shielding shell pass through the respective wire passage holes. Each waterproof plug 41 includes a waterproof plug body 42 disposed at least around a periphery of the terminal 31 and a periphery of the end portion of the wire 30, and a resin member 43 embedded in the waterproof plug body 42. The waterproof plug body 42 abuts against that portion of the front face of the shielding shell 12 defining an edge portion of the wire passage hole 26, 27, and the resin member 43 is disposed to extend at least in an axial direction of the waterproof plug body 42, and passes through the wire passage hole 26, 27 to extend rearwardly from the shielding shell 12.

2 Claims, 5 Drawing Sheets

SHIELD CONNECTOR

BACKGROUND OF THE INVENTION

1. Field of the Invention

This invention relates to a shield connector in which a shielding shell is mounted on a housing receiving terminals of terminal-equipped wires.

2. Description of the Related Art

In one known shield connector 70 shown in FIG. 5, a waterproof plug (rubber plug) 76 is fitted on a wire 75 of a terminal-equipped wire 74 having a terminal 73 received in a cavity 72 of a housing 71, and shielding shells 78 and 79 holding a shielding member 77 therebetween are fixedly secured to the housing 71, and a rubber plug holder 80 having the wire 75 passed therethrough is attached to a rear end portion of the housing 71 (see, for example, Patent Literature 1).

In this shield connector 70, the inner periphery of the waterproof plug 76 is disposed in intimate contact with the wire 75, and the outer periphery of the waterproof plug 76 is held in intimate contact with an inner surface of the cavity 72 of the housing 71, and therefore the outer periphery of the wire 75 and the inner periphery of the cavity 72 are sealed in a waterproof manner.

Patent Literature 1: JP-A-2005-129355 (FIG. 1)

However, the shield connector 70 disclosed in the above Patent Literature 1 has the following three problems.

Referring to the first problem, the waterproof plug 76 which is held in intimate contact with the wire 75 and is also held in intimate contact with the inner surface of the cavity 72 of the housing 71 has a simple annular ring-shape, and is mounted on that portion of the wire 76 spaced from the terminal 73, and therefore its sealing ability is not high.

The second problem is that since the waterproof plug 76 is mounted on part of the wire 75 which is relatively short in the direction of the length thereof, and therefore it is difficult for the waterproof plug 76 to have a large retaining force for retaining itself.

The third problem is that since the waterproof plug 76 is mounted on part of the wire 75 which is relatively short in the direction of the length thereof as described above for the second problem, it is difficult for the waterproof plug 76 to have a large retaining force for retaining the wire 75.

SUMMARY OF THE INVENTION

This invention has been made in view of the above problems, and an object of the invention is to provide a shield connector in which a sealing ability, a force for retaining a waterproof plug, and a force for retaining a wire can be enhanced.

The above object of the present invention has been achieved by the following construction.

(1) A shield connector is characterized in that the connector comprises:

a terminal-equipped wire having a terminal connected to an end portion of its wire;

a housing receiving the terminal of the terminal-equipped wire;

a shielding shell mounted on the housing; and a waterproof plug mounted at least on the terminal of the terminal-equipped wire and the end portion of the wire at a region between the housing and the shielding shell; and the shielding shell has a wire passage hole formed in a rear face thereof, and the wire of the terminal-equipped wire mounted in the housing disposed on a front face of the shielding shell passes through the wire passage hole; and the waterproof plug includes a waterproof plug body disposed at least around a periphery of the terminal and a periphery of the end portion of the wire, and a resin member embedded in the waterproof plug body to serve as a core member; and the waterproof plug body abuts against that portion of the front face of the shielding shell defining an edge portion of the wire passage hole, and the resin member is disposed to extend at least in an axial direction of the waterproof plug body, and passes through the wire passage hole to extend rearwardly from the shielding shell.

(2) A shield connector according to the above Paragraph (1) is characterized in that there are provided a plurality of the terminal-equipped wires, and a plurality of the wire passage holes are formed in the shielding shell, and the wires of the plurality of wire-equipped wires pass through the plurality of wire passage holes, respectively, and a plurality of the waterproof plugs are mounted on the plurality of terminal-equipped wires, respectively.

In the shield connector of the above Paragraph (1), the waterproof plug is mounted at least on the terminal of the terminal-equipped wire and the end portion of the wire at the region between the housing and the shielding shell, and the elastic waterproof plug body abuts against that portion of the front face of the shielding shell defining the edge portion (peripheral edge portion) of the wire passage hole, thereby preventing water and others from intruding into the interior of the shielding shell.

Furthermore, the resin member is disposed to extend in the axial direction of the waterproof plug body, and passes through the wire passage hole to extend rearwardly from the shielding shell, and therefore this resin member can increase the rigidity of the waterproof plug body abutting against the shielding shell.

Furthermore, because of the provision of the resin member, a force of intimate contact of the waterproof plug with the terminal and the end portion of the wire is increased, and therefore the waterproof plug produces a large retaining force for retaining the terminal-equipped wire.

Furthermore, when the wire, led out from the shielding shell through the wire passage hole, is bent, this wire is directly held against the resin member, and will not contact the shielding shell, and therefore damage to the wire can be prevented.

With this construction, even when the shielding shell has the wire passage hole formed in the rear face thereof, the sealing ability, the retaining force for retaining the waterproof plug, and the retaining force for retaining the wire can be enhanced.

In the shield connector of the above Paragraph (2), the wire passage holes are provided respectively for the plurality of terminal-equipped wires, and the waterproof plugs are mounted respectively on the terminal-equipped wires, and in each of the terminal-equipped wires, the sealing ability, the retaining force for retaining the waterproof plug, and the retaining force for retaining the wire can be enhanced.

In the present invention, the shield connector comprises the terminal-equipped wire having the terminal connected to the end portion of its wire, the housing receiving the terminal of the terminal-equipped wire, the shielding shell mounted on the housing, and the waterproof plug mounted at least on the terminal of the terminal-equipped wire and the end portion of the wire at the region between the housing and the shielding shell, and in this construction, even when the shielding shell has the wire passage hole formed in the rear face thereof, the sealing ability, the retaining force for retaining the waterproof plug, and the retaining force for retaining the wire can be enhanced.

DESCRIPTION OF THE PREFERRED EMBODIMENTS

A preferred embodiment of the present invention will now be described in detail with reference to the drawings.

Figure 1:
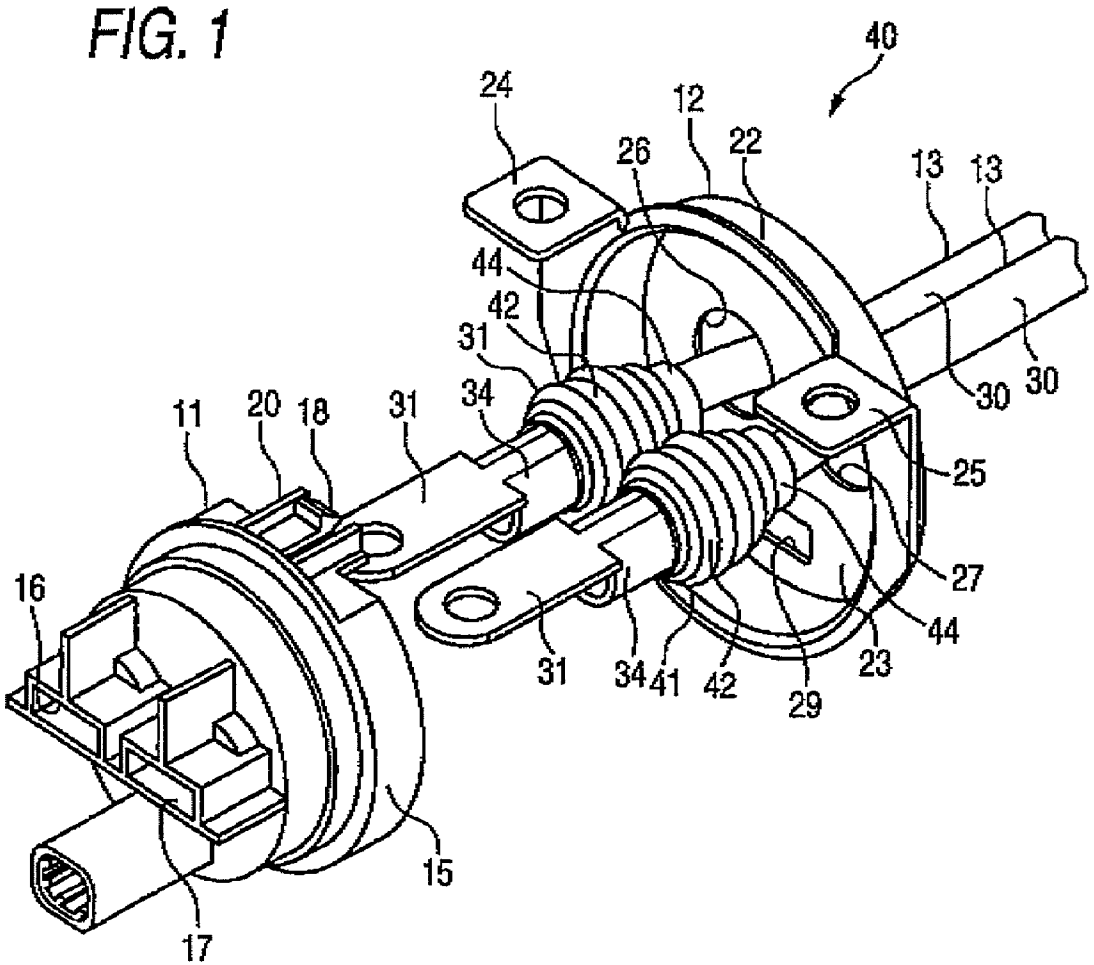
FIG. 1 is an exploded perspective view of one preferred embodiment of a shield connector of the present invention as seen from the housing side.
Figure 2:
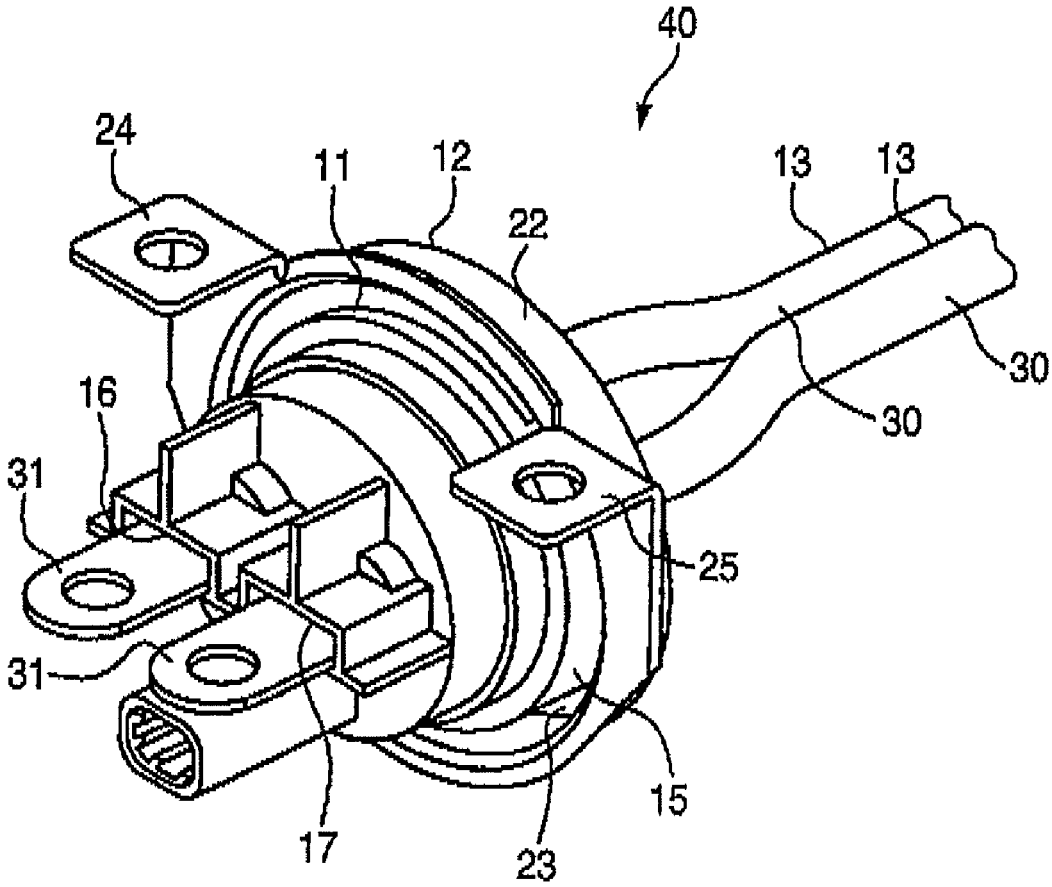
FIG. 2 is a perspective view of the shield connector of FIG. 1 in its assembled condition.
Figure 3:
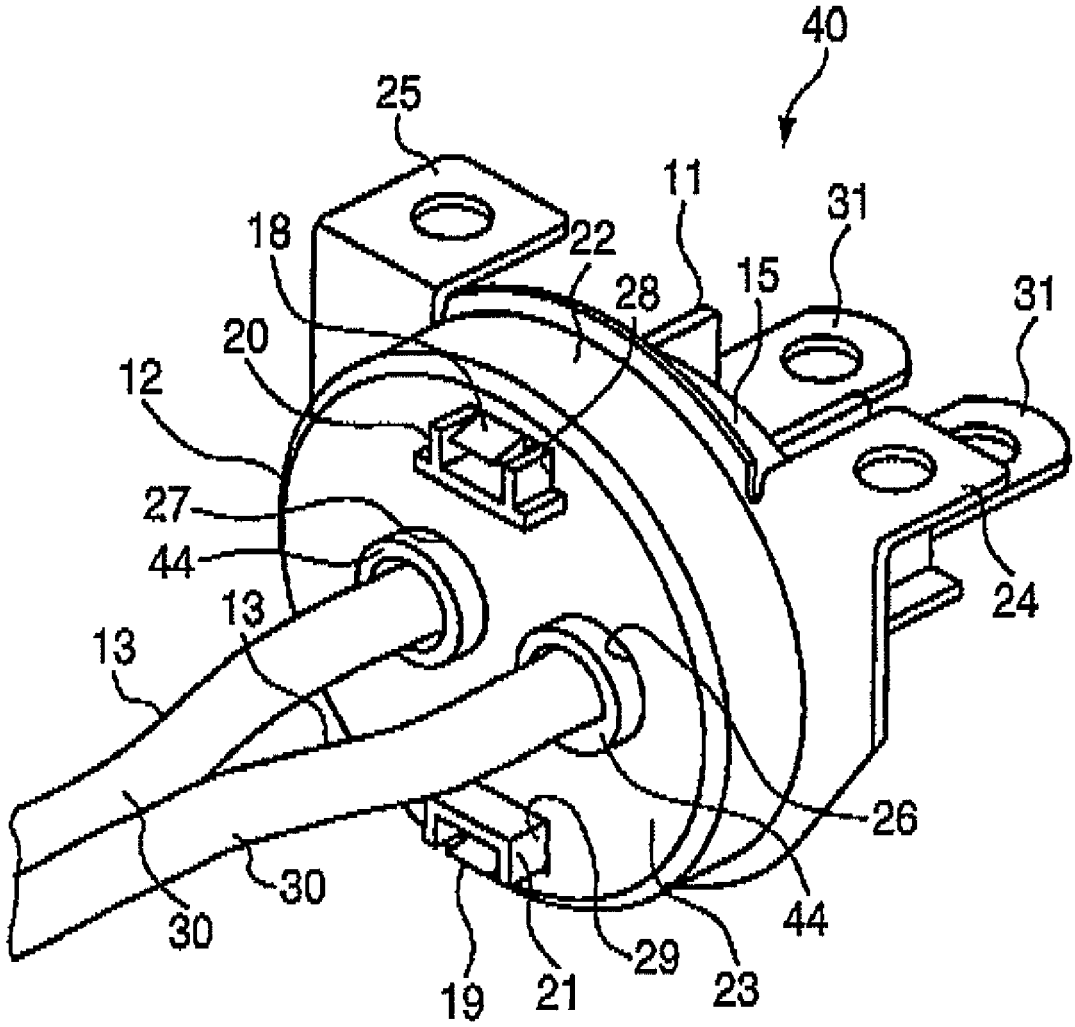
FIG. 3 is a perspective view of the shield connector of FIG. 2 as seen from the shielding shell side.
Figure 4:
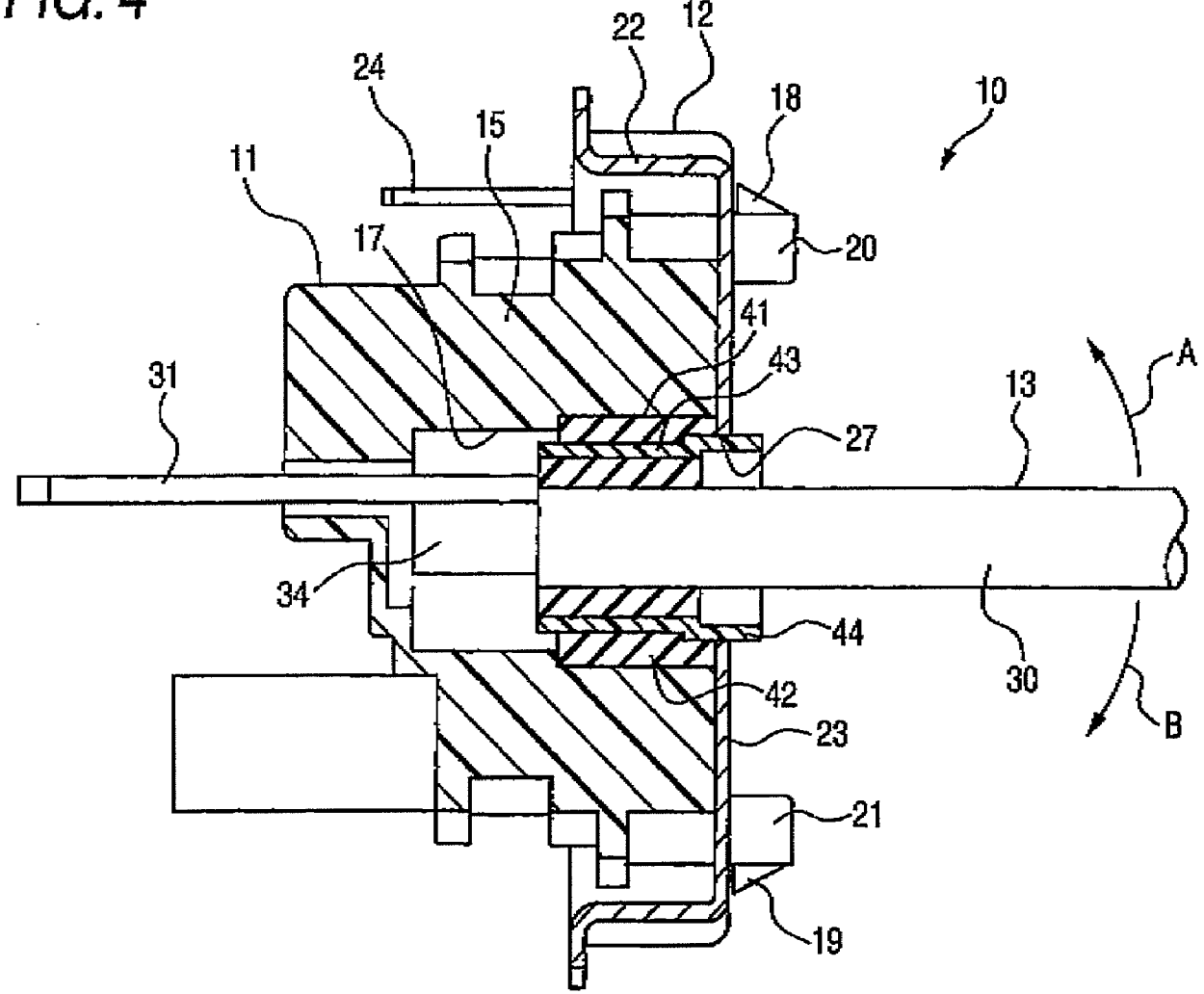
FIG. 4 is a longitudinal cross-sectional view of the shield connector of FIG. 2, showing those portions around a terminal.
Figure 5:
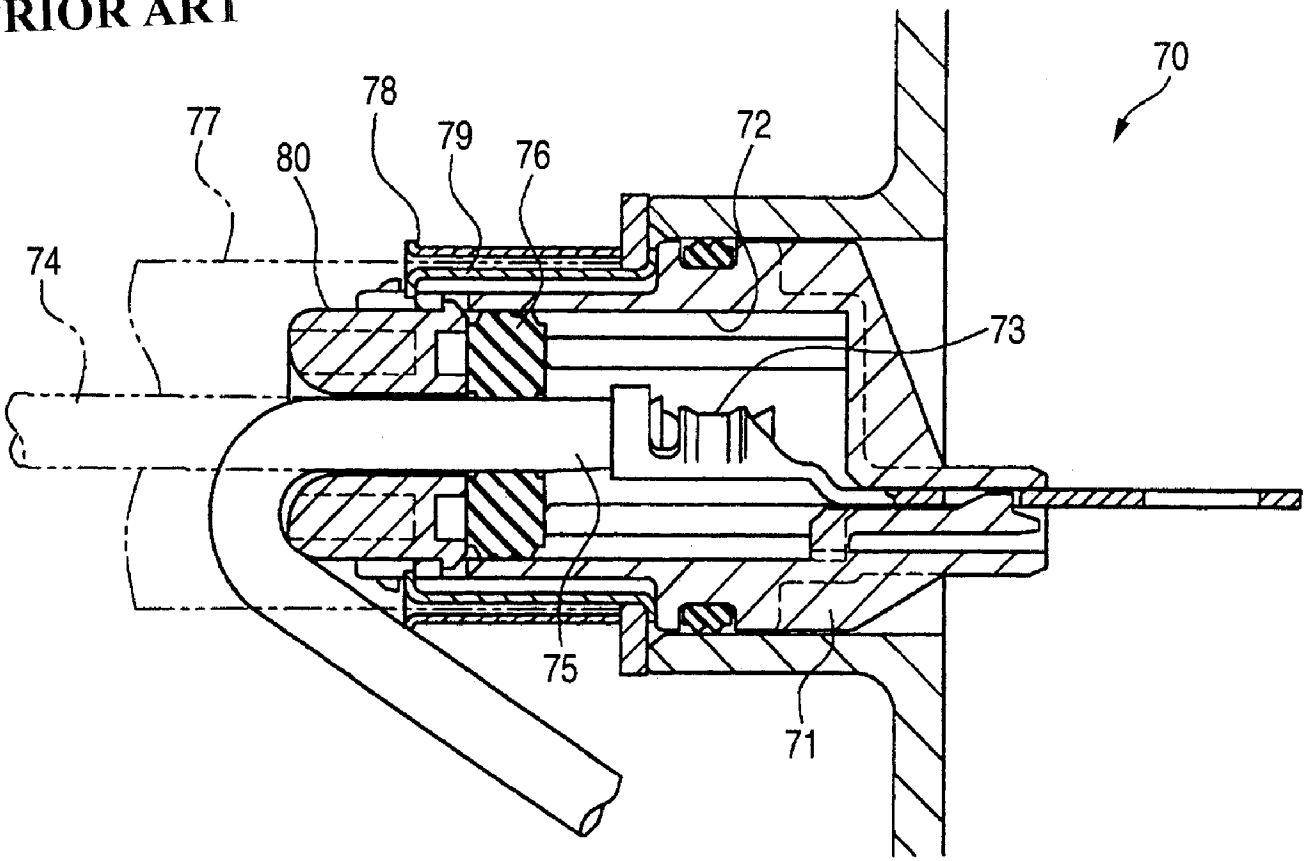
FIG. 5 PRIOR ART
FIG. 5 is a cross-sectional view of a conventional shield connector.

FIGS. 1 to 4 show one preferred embodiment of a shield connector of the invention, and FIG. 1 is an exploded perspective view of the shield connector of this embodiment as seen from the housing side, and FIG. 2 is a perspective view of the shield connector of FIG. 1 in its assembled condition, and FIG. 3 is a perspective view of the shield connector of FIG. 2 as seen from the shielding shell side, and FIG. 4 is a longitudinal cross-sectional view of the shield connector of FIG. 2, showing those portions around a terminal.

As shown in FIG. 1, the shield connector 40 of this embodiment comprises a housing 11, a shielding shell 12, terminal-equipped wires 13, and waterproof plugs 41, and a braided conductor (not shown) is electrically connected to the shielding shell 12.

The housing 11 functions as a male connector housing, and includes a housing body 15 of a cylindrical shape made of an insulative resin.

The housing 11 has a pair of juxtaposed terminal cavities 16 and 17 formed through a central portion (in an upward-downward direction) of the housing body 15, and one end portion of each terminal cavity 16, 17 (which is to face a female connector housing (not shown)) is formed into a square or rectangular hole while the other end portion thereof (which is to face away from the female connector housing) is formed into a circular hole.

A pair of opposed elastic retaining piece portions 18 and 19 (the elastic retaining piece portion 19 is shown in FIG. 3) are formed respectively at upper and lower portions (disposed close to an outer peripheral surface of the housing body 15) of an end face (to which the circular holes of the terminal cavities 16 and 17 are open) of the housing body 15, and project from the housing body 15 in an axial direction. Generally U-shaped ribs 20 and 21 (the rib 21 is shown in FIG. 3) are formed on the end face of the housing body 15, and generally surround the elastic retaining piece portions 18 and 19, respectively.

The shielding shell 12 is formed into an annular ring-shape or a cylindrical shape with a closed bottom, using electrically-conductive metal, and this shielding shell 12 has a side plate (or end plate) 23 (defining the bottom) formed at one end of its ring portion 22 facing away from the housing 11. When the braided conductor is connected to the shielding shell 12, the shielding shell 12 forms a grounding circuit for preventing a disturbance and others. The shielding shell 12 has a pair of flange-like fixing portions 24 and 25 formed respectively at opposite side portions of the ring portion 22 and extending upwardly.

A pair of juxtaposed wire passage holes 26 and 27 of a circular shape are formed through a central portion (in the upward-downward direction) of the side plate 23 of the shielding shell 12. An engagement hole 28 is formed through the side wall 23, and is disposed above the wire passage holes 26 and 27, and also another engagement hole 29 (which is shown in FIG. 3) is formed through the side wall 23, and is disposed below the wire passage holes 26 and 27.

Male terminals 31 are electrically connected respectively to end portions of the wires 30 of the terminal-equipped wires 13. Each of the waterproof plugs 41 has a bellows-shape, and includes a waterproof plug body 42, and a resin member 43 (shown in FIG. 4) embedded in the waterproof plug body 42. The resin member 43 has an extension portion 44 of a larger diameter extending rearwardly. The extension portions 44 of the resin members 43 of the two waterproof plugs 41 extend respectively through the wire passage holes 26 and 27, and project rearwardly from the wire passage holes 26 and 27, respectively.

Each wire 30 is passed through the waterproof plug 41 before the male terminal 31 is connected to the wire 30, and after an electrical connection portion 34 of the male terminal 31 is electrically connected to a conductor (not shown) of the wire 30, the waterproof plug 41 is mounted on an outer periphery of the electrical connection portion 34 of the male terminal 31 and an outer periphery of the connection end portion of the wire 30 over a predetermined length in the axial direction (that is, in the direction of the axis of the wire 30).

In the assembling of the shield connector 40, the male terminals 31 of the terminal-equipped wires 13 (having their wires 30 passed through the respective wire passage holes 26 and 27 of the shielding shell 12) are inserted respectively into the terminal cavities 16 and 17 of the housing 11 from the rear side, and are fixed thereto, so that the male terminals 31 project forwardly respectively from the terminal cavities 16 and 17 of the housing 11, as shown in FIG. 2. Then, the housing 11 is pressed toward the shielding shell 12.

As shown in FIG. 4, the elastic retaining piece portion 19 (which makes, together with the upper elastic retaining piece portion 18, a pair) is formed on the housing 11, and the rib 21 is formed in surrounding relation to this elastic retaining piece portion 19. The lower engagement hole 29 (which makes, together with the upper engagement hole 28, a pair) is formed through the side plate 23 of the shielding shell 12.

Then, in the assembling of the shield connector 40, the elastic retaining piece portion 18 and the rib 20 are inserted into the engagement hole 28 of the shielding shell 12, while the elastic retaining piece portion 19 and the rib 21 are inserted into the engagement hole 29, and the elastic retaining piece portions 18 and 19 are engaged in the engagement holes 28 and 29, respectively. Then, when the housing body 15 of the housing 11 abuts against the side plate 23 of the shielding shell 12, the wires 30 of the wire-equipped wires 13 are extended rearwardly from the wire passage holes 26 and 27 of the shielding shell 12, respectively, thus completing the assembling operation.

As shown in FIG. 4, each waterproof plug 41 mounted on the terminal-equipped wire 13 includes the waterproof plug body 42 made of an elastic material and molded into an integral construction such that the waterproof plug body 42 covers the inner periphery and outer periphery of the resin member 43 made of a resin and formed into a cylindrical shape. Therefore, when the housing 11 is mounted on the shielding shell 12, the rear end of the waterproof plug body 42 abuts against the front face of the shielding shell 12, and also the outer peripheral surface of the waterproof plug body 42 is held against the inner peripheral surface of the terminal cavity 17.

In this case, the waterproof plug 41 has an increased rigidity as a whole because of the provision of the embedded resin member 43, and therefore is less liable to be bent in the axial direction and the radial direction of the wire, and has a higher sealing ability as compared with the conventional waterproof plug of a simple annular ring-shape. In addition, because of the provision of the embedded resin member 43, the waterproof plug 41 produces a large retaining force for retaining itself. Furthermore, because of the provision of the embedded resin member 43, a force of intimate contact of the waterproof plug 41 with the electrical connection portion 34 (of the male terminal 31) and the connection end portion of the wire 30 is increased, and therefore the waterproof plug 41 produces a large retaining force for retaining the terminal-equipped wire 13.

As described above, in the shield connector 40 of this embodiment, each waterproof plug 41 having the resin member 43 embedded in the waterproof plug body 42 is mounted on the wire 30 of the terminal-equipped wire 13 led out from the wire passage hole 26, 27 formed in the rear face of the shielding shell 12. The waterproof plug 41 has the increased rigidity as a whole because of the provision of the resin member 43, and therefore is less liable to be bent in the axial direction of the wire 30, and can enhance the sealing ability, and thus the enhanced sealing ability can be achieved.

In each waterproof plug 41 mounted on the electrical connection portion 34 of the male terminal 31 (of the terminal-equipped wire 13) and the end portion of the wire 30 at the region between the housing 11 and the shielding shell 12, the elastic waterproof plug body 42 abuts against that portion of the front face of the shielding shell 12 defining an edge portion (peripheral edge portion) of the wire passage hole 26, 27, thereby preventing water and others from intruding into the interior of the shielding shell 12. Furthermore, the resin member 43 is disposed to extend in the axial direction of the waterproof plug body 42, and therefore can increase the rigidity of the waterproof plug body 42 abutting against the shielding shell 12.

Furthermore, when the wire 30, led out from the shielding shell 12 through the wire passage hole 27, is bent in a direction A or a direction B (see FIG. 4) or bent in a predetermined direction in a path of installation of the wire, this wire 30 is directly held against the extension portion 44 of the waterproof plug 41 projecting rearwardly from the shielding shell 12, and therefore will not contact the shielding shell 12, and is prevented from damage which would otherwise be caused by direct contact with the metallic shielding shell 12.

Furthermore, the resin member 43 has the extension portion 44 of a larger diameter increased in the radial direction, and therefore the waterproof plug body 42 and the resin member 43 are prevented from being displaced relative to each other in the axial direction.

The present invention is not limited to the above embodiment, and suitable modifications, improvements, etc., can be made. Furthermore, the material, shape, dimensions, numerical value, form, number, disposition, etc., of each of the constituent elements of the above embodiment are not limited, and are arbitrary in so far as the invention can be achieved.

For example, in the above embodiment, although the two terminal-equipped wires are used, three or more terminal-equipped wires can be used, in which case the waterproof plugs are mounted on these terminal-equipped wires, respectively.

In the above embodiment, the waterproof plug body may be extended to cover the inner periphery surface of the extension portion 44, and with this construction the sealing ability and the wire retaining force can be further enhanced.

What is claimed is:

1. A shield connector, comprising:

a terminal-equipped wire having a terminal connected to an end portion of the terminal-equipped wire;

a housing receiving the terminal of the terminal-equipped wire;

a shielding shell mounted on the housing; and a waterproof plug mounted at least on the terminal of the terminal-equipped wire and the end portion of the wire at a region between the housing and the shielding shell; and the shielding shell has a wire passage hole formed in a rear face thereof, and the wire of the terminal-equipped wire mounted in the housing disposed on a front face of the shielding shell passes through the wire passage hole; and the waterproof plug includes a waterproof plug body disposed at least around a periphery of the terminal and a periphery of the end portion of the wire, and a resin member embedded in the waterproof plug body to serve as a core member; and the waterproof plug body abuts against that portion of the front face of the shielding shell defining an edge portion of the wire passage hole, and the resin member is disposed to extend at least in an axial direction of the waterproof plug body, and passes through the wire passage hole to extend rearwardly from the shielding shell.

2. The shield connector according to claim 1, wherein there are provided a plurality of the terminal-equipped wires, and a plurality of the wire passage holes are formed in the shielding shell, and the wires of the plurality of wire-equipped wires pass through the plurality of wire passage holes, respectively, and a plurality of the waterproof plugs are mounted on the plurality of terminal-equipped wires, respectively.

* * * * *